United States Patent [19]

Pryputsch et al.

[11] Patent Number: 4,503,760

[45] Date of Patent: Mar. 12, 1985

[54] FORCED CONVECTION OVEN

[75] Inventors: Gunter G. Pryputsch, South Delta; Lennox M. Leila, Richmond; Gerald E. Parkinson, Vancouver; Leonard A. Arneson, Port Coquitlam, all of Canada

[73] Assignee: Omega Air Flow-21, Ltd., S. Delta, Canada

[21] Appl. No.: 308,158

[22] Filed: Oct. 5, 1981

[51] Int. Cl.[3] ..... A47J 27/026

[52] U.S. Cl. ..... 99/447; 99/450; 99/467; 99/473; 99/476; 126/21 A

[58] Field of Search ..... 99/447, 474, 476, 418, 99/449, 467, 473, 474, 483, 500, 450; 126/21 A; 219/400

[56] References Cited

U.S. PATENT DOCUMENTS

| | | | |
|---|---|---|---|
| 1,649,488 | 11/1927 | Robinson et al. | 99/474 X |
| 2,422,102 | 6/1947 | Kline | 34/133 X |
| 3,316,659 | 5/1967 | Lauck | 34/133 |
| 3,828,760 | 8/1974 | Farber et al. | 126/21 A |
| 4,068,572 | 1/1978 | Vogt | 219/400 X |
| 4,091,548 | 5/1978 | Daily | 34/133 |
| 4,154,861 | 5/1979 | Smith | 99/447 X |
| 4,155,294 | 5/1979 | Langhammer et al. | 99/447 X |

FOREIGN PATENT DOCUMENTS

| | | | |
|---|---|---|---|
| 1090943 | 1/1960 | Fed. Rep. of Germany | 99/473 |
| 1198612 | 12/1959 | France . | |
| 96110 | 11/1960 | Netherlands | 34/133 |
| 0564337 | 6/1975 | Switzerland | 99/450 |

*Primary Examiner*—Philip R. Coe
*Assistant Examiner*—Arthur D. Dahlberg
*Attorney, Agent, or Firm*—Carver & Co.

[57] ABSTRACT

An oven for food comprises a housing and a stationary support inside the housing with a position for supporting the food. A fan and an electric element supply a stream of hot air to the inside of the housing. A rotating drum has a supply opening for directing the stream of hot air towards the position for the food and for moving the stream of hot air about the position for the food to heat or cook the food.

30 Claims, 5 Drawing Figures

FORCED CONVECTION OVEN

BACKGROUND OF THE INVENTION

This invention relates to a forced convection oven for food.

Development of the fast food business has led to considerable demand for quick and efficient means for heating and cooking food. The demand is also present in relation to domestic food preparation because of today's faster lifestyles. One development in satisfaction of this demand has been the widespread acceptance of microwave ovens. Microwave ovens are relatively energy efficient, while considerably decreasing the heating or cooking time when compared with standard ovens or stoves. However, one problem associated with microwave ovens is that the food is heated without the surface browning associated with, for example, baking or frying. The surface browning gives the food a desirable appearance, texture and taste. This means that some items, such as french fried potatoes and pizza pies, are not cooked by a microwave oven in a manner satisfactory to many people.

The common way of heating and cooking frozen french fried potatoes is deep frying in hot fat or oil. However, when deep frying is carried on at a business premises, it may give rise to increased fire insurance rates. This may mean that food outlets at shopping centers, for example, are prohibited from using deep frying as the fire insurance for the entire shopping center would increase. If french fries are to be sold, the operator of the food outlet is forced to find alternative means of cooking. One solution is embodied in the cooking apparatus disclosed in U.S. Pat. No. 4,155,294 to Langhammer. In this device, the french fries or other food is placed in a cage which is rotated within a stationary drum while a stream of hot air is directed towards the cage through an aperture in the wall of the drum. The rotation of the cage relative to the stream of hot air assures uniform cooking of the food. However, it is readily apparent that this apparatus is not suitable for cooking many foods due to the tumbling action within the cage. Foods such as pizzas and submarine sandwiches would be destroyed by the tumbling action.

U.S. Pat. No. 2,939,383 to Kanaga discloses a cooking device wherein food is tumbled within a rotating drum while being cooked by radiant heating.

U.S. Pat. No. 4,184,420 to Podaras shows a barbeque oven including a rotatable meat holder. A plurality of racks for supporting food are pivotally connected to the meat holder so the racks remain upright as the meat holder rotates.

Other cooking apparatuses having a rotating drum with food positioned therein are disclosed in U.S. Pat. Nos. 4,048,473 to Burkhart; 2,004,775 to Wright and 4,165,684 to Wallace.

None of the earlier devices discussed above offers a satisfactory solution to the problem of quickly and properly cooking many types of food items, such as sandwiches or pizzas, which cannot be tumbled in a rotating drum.

SUMMARY OF THE INVENTION

The invention provides a device for cooking or heating food which comprises a housing with an inside and a stationary support inside the housing with a position for supporting the food. There is means for supplying a stream of hot air to the inside of the housing and means for directing the stream of hot air towards the position for the food and for moving the stream of hot air about the position for the food to uniformly heat or cook the food.

Advantageously, the means for directing may comprise a rotatable drum. The drum has an inside, an outside and a cylindrical side wall with a supply opening for permitting the stream of hot air to pass from the outside of the drum to the inside. Rotation of the drum causes the supply opening to rotate about the support and the food so the stream of hot air moves about the food. Preferably, the drum has a return air opening for permitting the stream of hot air to return from the inside of the drum to the outside of the drum.

The means for supplying the stream of hot air may comprise a fan, a supply conduit extending from the fan to the drum near the supply opening thereof and means for heating the stream of hot air from the fan.

Preferably, the device further comprises an annular hot air chamber in the housing which extends about the drum to communicate with the supply opening. The electric element is within the chamber and the supply conduit communicates with the chamber. In a preferred form, the drum has a closed back end, the return air opening being on the side wall of the drum near the back end. In this case, the oven further comprises an annular, return air chamber in the housing which extends about the drum to communicate with the return air opening. The fan has an intake communicating with the return chamber so that hot air returning from the inside of the drum is recirculated by the fan through the supply conduit towards the food.

The invention offers definite and unexpected advantages when compared with prior art cooking devices. Delicate foods, for example, are evenly browned while remaining intact. At the same time, cooking or heating periods are considerably shortened when compared with conventional ovens and energy requirements are reduced.

DESCRIPTION OF THE PREFERRED EMBODIMENTS

Figure 3:
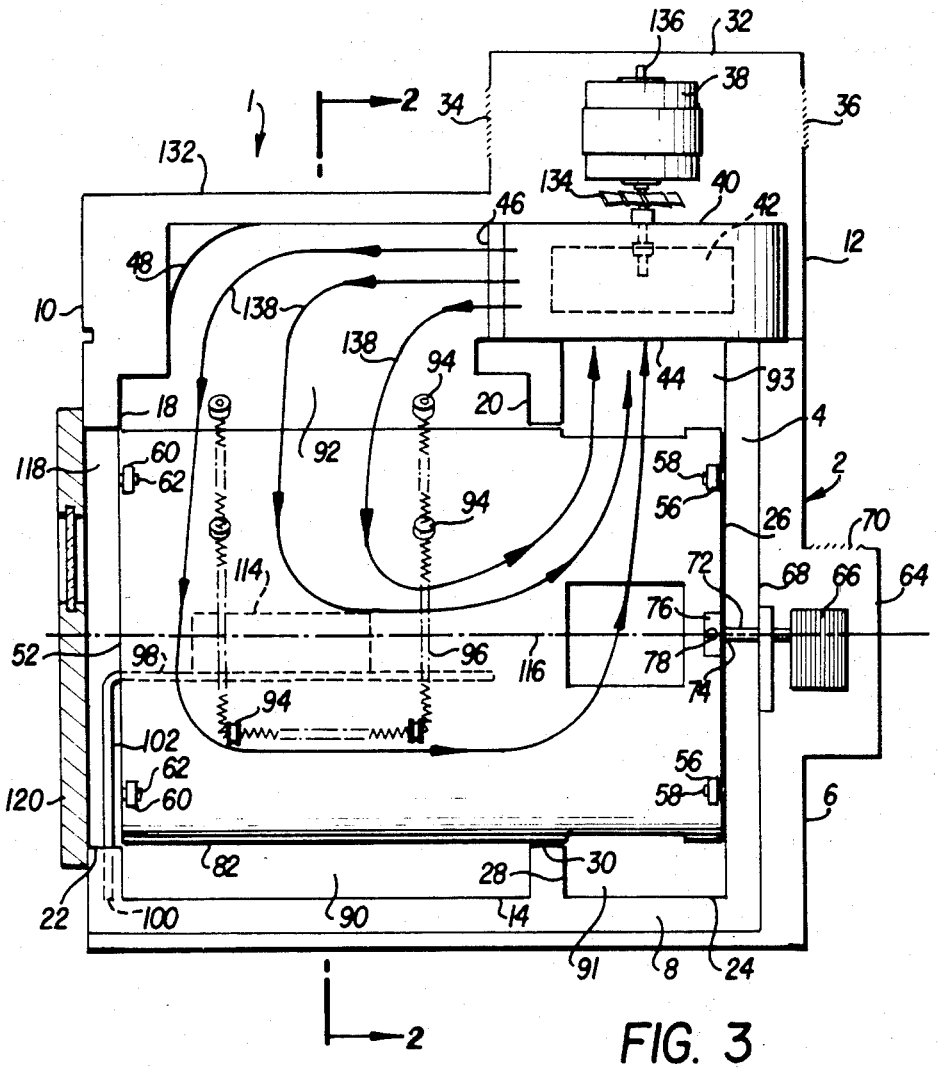
FIG. 3 is a sectional view taken along line 3—3 of FIG. 2.

The drawings illustrate a device or oven 1 which is used for cooking or heating food. The device is particularly adapted for cooking such food items as french fries, pizzas or sandwiches where a browned or toasted quality is required as normally produced by frying or baking. The device 1 includes a housing 2 with an inside 4. The housing 2 is constructed of sheet metal, preferably stainless steel for durability, ease of cleaning and appearance. The housing has an outside shell 6 surrounded by a layer of perimeter insulation 8, such as glass fiber, to prevent a loss of heat and to keep the shell 6 cool. The housing has a front 10 and a back 12 as seen in FIG. 3.

An octagonal hot air chamber casing 14 is supported in the inside 4 of the housing by a plurality of support channels 16. The chamber casing 14 extends rearwardly from near the front 10 of housing 4. An annular front wall 18 and a similar back wall 20 extend inwardly from the octagonal casing 14. A seal 22, which is circular in section, extends between the inside of front wall 18 and the shell 6.

A return air casing 24 extends from near the back wall 20 to near the back 12 of the housing. Casing 24 has a similar octagonal shape to hot air chamber casing 14, but is shorter. A closed back wall 26, which is octagonal in shape, is connected to the back end of return air casing 24, while an annular front wall 28 is at the opposite end. A circular seal 30 connects back wall 20 and front wall 28 as shown in FIG. 3.

Housing 2 has a projection 32 on the top thereof near its back 12. Projection 32 has front and rear louvers 34 and 36 and houses a fan motor 38. Motor 38 provides power for a centrifugal-type fan 40 which has an impeller 42. The fan has an intake opening 44 on the bottom and a side discharge 46 which is connected to an elbow-shaped supply conduit 48. A cooling fan 134 is mounted on shaft 136 of the motor 38.

A hot air distributor drum 50 is rotatably received within housing 2. The drum is hollow and has an open front end 52 and a closed back end 54. The back end 54 of the drum is supported by four rollers 56, each of which is rotatably mounted on an axle 58 connected to back wall 26. The front end of the drum is supported by four similar rollers 60 which are rotatably mounted on axles 62 connected to front wall 18. Rollers 58 and 60 support the drum 50 while permitting rotation thereof.

The housing 2 has a rear projection 64 housing an electric motor 66 which is mounted on a vertical internal wall 68 of housing 2. A louver 70 is provided on the top of rear projection 64 for cooling purposes. Motor 66 has a drive shaft 72 which extends rotatably through aperture 74 in back wall 26 and is connected to the closed back end 54 of drum 50 by means of a coupling member 76 welded to the back of the drum and a set screw 78. Motor 66 is thereby operatively connected to the drum for rotating the same.

Figure 4:
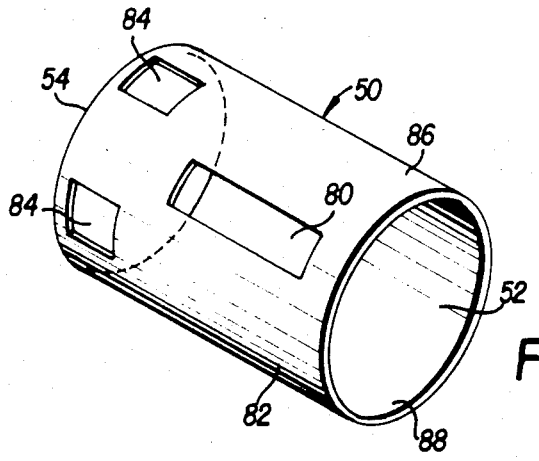
FIG. 4 is an isometric view of the rotatable drum from the embodiment of FIGS. 1 to 3.
Figure 5:
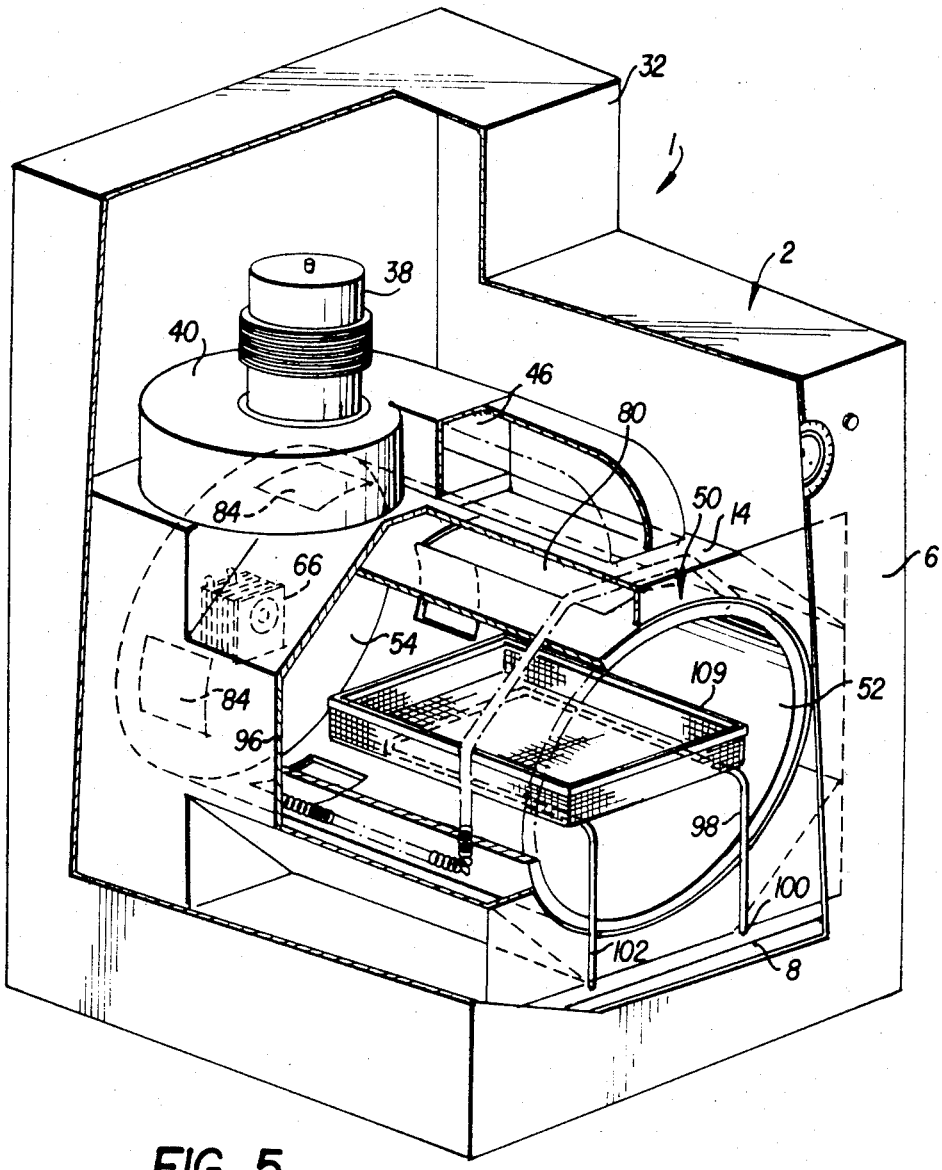
FIG. 5 is a perspective view of the device with the housing partly broken away.

With reference to FIG. 4, it may be seen that drum 50 has a single supply opening 80 on its side wall 82. Supply opening 80 is rectangular in shape in this embodiment. The drum also has four return air openings 84 in the side wall near the back end 54 of the drum. The return air openings are also rectangular in this embodiment. The openings in the side wall permit communication between outside 86 of the drum and its inside 88.

Figure 1:
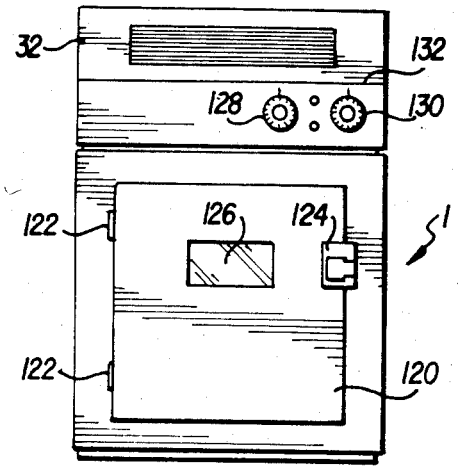
FIG. 1 is a front view of a device for cooking or heating food according to an embodiment of the invention.
Figure 2:
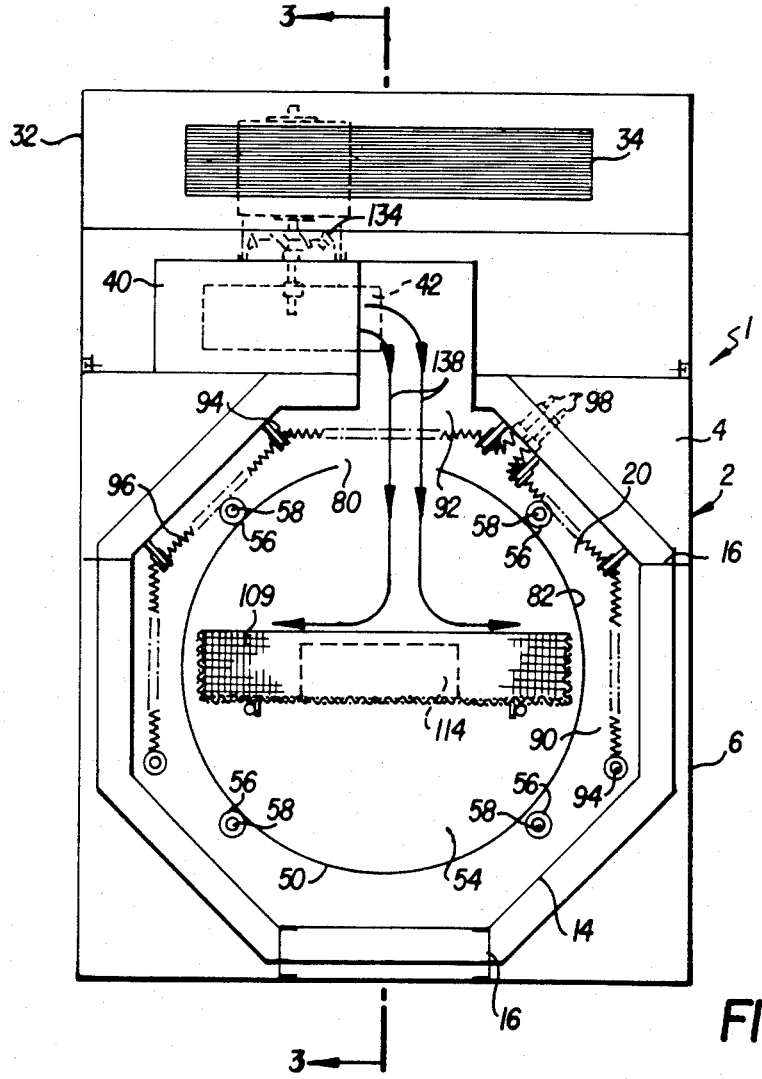
FIG. 2 is a sectional view taken along line 2—2 of FIG. 3.

With reference to FIGS. 2 and 3, it may be seen that an annular hot air chamber 90 is formed between the octagonal casing 14, side wall 82 of the drum 50, front wall 18 and back wall 20. An opening 92 on the top of chamber 90 communicates with the supply conduit 48 from the fan 40. The chamber 90 is sealed on each side adjacent the side wall of the drum by peripheral seals 22 and 30.

Similarly, an annular return air chamber 91 comprises the space between return air casing 24, side wall 82 of the drum, front wall 28 and back wall 26. An opening 93 in casing 24 at the top of chamber 91 communicates with the intake 44 of the fan. The chamber 91 is sealed on each side by peripheral seal 22 adjacent the side wall of the drum and by the back wall 26.

A plurality of insulators 94 are mounted on the inside of casing 14 and support an electric heating element 96. The element is loop-shaped and is connected to terminals 98. As seen best in FIG. 2, element 96 does not extend about the bottom of the drum 50 to help cleaning since crumbs and other pieces of food will collect at the bottom of casing 14.

An L-shaped cantilevered bracket 99 has the bottom 100 of its vertical portion 102 connected to the housing 2 near the open front end 52 of the drum. The bracket has a horizontal portion which includes a pair of parallel, horizontal bars 104 and 106 which are joined together at their back ends by a perpendicular bar 108. A perforated tray 109 is slidably received on top of the bracket. A pair of downwardly extending flanges 110 and 112 keep the tray properly centered on the bracket. Bracket 99 together with tray 109 serve as a stationary support inside the housing 2 with a position for supporting food 114 as indicated in broken lines in FIGS. 2 and 3. Drum 50 has a horizontal axis of rotation 116 which passes near or through the food 114, depending upon its thickness, and through the center of drive shaft 72. Accordingly, as the drum rotates, the supply opening 80 maintains an approximately equal distance from the center of the food.

Housing 2 has a circular front opening 118 adjacent the open front end 52 of the drum. Seal 22 acts to peripherally seal the drum between its front end and a front opening 118 of housing 2. A door 120 is provided for sealing the front opening 118 when the oven is in use and for providing access to the food support provided by bracket 98 and tray 109 within the drum. Door 120 is hingedly mounted by means of a pair of side hinges 122 and a latch mechanism 124 keeps the door shut during use. A view window 126 of heat resistant glass permits visual inspection of the food during heating or cooking.

The controls for the cooking device includes a rotary temperature knob 128 and a rotary timer knob 130, both conveniently located above door 120 on the front 10 of the housing 2. A warming shelf 132 is provided on the top of housing 2 in front of the projection 32. The projection is kept cool by the cooling fan 134, mounted on the shaft 136 of motor 38, and louvers 34 and 36 in the projection.

In operation, latch 124 is disengaged and door 120 is opened so the food 114 can be placed on the perforated tray 109 resting on bracket 98. When the food is thus positioned, as shown in FIGS. 2 and 3, the supply opening 80 in the drum is positioned outwards from the food. The door is closed, latch 124 engaged and then knobs 128 and 130 are used to set the selected temperature and time respectively. A typical temperature would be 450° Farenheit. The time for cooking is substantially less than for conventional ovens.

The setting of knobs 128 and 130 provides power to motors 38 and 66 together with electric element 96. Fan 40 together with element 96 serve as means for supplying a stream of hot air to the inside of the housing 2. The hot air, represented by lines 138 in FIGS. 2 and 3, is forced outwardly through the discharge 46 of fan 40 and passes downwardly from elbow-shaped supply conduit 48. The air passes through opening 92 in the top of hot air chamber casing 14 and passes into hot air chamber 90 where it is heated, if required, by electric element 96. Element 96 is thermostatically controlled in the conventional manner to provide a stream of hot air at the temperature set on knob 128.

The hot air from chamber 90 can pass from the outside 86 of drum 50 to the inside 88 only through supply opening 80 in the drum. This is the only exit for the hot air from the chamber 90 because of seals 22 and 30 which serve to peripherally seal the drum to each side of the chamber 90. Opening 80 is illustrated at the top of drum 50 in FIG. 2 so the hot air is directed onto the top of the food 114. However, as the drum rotates, the opening moves about the food so the hot air is directed on the sides and bottom of the food as well. In this way, the rotating drum 50 acts as means for directing the stream of hot air towards the position of the food and for moving the stream of hot air about the position of the food to uniformly heat or cook the food. A speed of 7 revolutions per minute for drum 50 has been found to be suitable. After passing over the surface of the food 114 to heat or cook the same, the hot air leaves drum 50 through the return air openings 84 and passes into the annular return air chamber 91 which extends about the drum to communicate with the return air openings 84. From chamber 91, the air is taken into the intake 44 of the fan through the opening 93. In this way, hot air returning from the inside of drum 50 is recirculated by the fan through the supply conduit 48 towards the food. It should be noted that the hot air is not exhausted from the housing and cold air is not drawn in to reduce energy requirements. Once the air has been brought to the proper temperature by element 96, the element operates only intermittently to make up for relatively small heat losses through the insulating housing 2.

The embodiment described above reduces cooking times significantly over standard ovens, while giving the desirable browned and cooked characteristics normally associated with baking or frying. This is achieved by forced convection in which the stream of hot air is directed onto the food and moved about the food in a rotating manner. Unlike some prior art forced convection cooking devices, the present invention is entirely suitable for pizzas, sandwiches and other types of foods which would be broken up if tumbled in a rotating basket or drum. The present invention permits the food to remain stationary while the rotating drum causes the stream of hot air to move about the food. The device is primarily intended for smaller restaurants or take-out food establishments, but is also suitable for domestic use. The device may also be adapted for use in coin-operated vending machines for the dispensing of hot food such as french fries. Larger versions may be used in bigger food preparation facilities.

What is claimed is:

1. A device for cooking or heating food, comprising:
(a) a housing with an inside;
(b) a stationary support inside said housing with a position for supporting food;
(c) means for supplying a stream of hot air to said inside;
(d) hollow drum means rotatably mounted to said housing in said inside and said stationary support projecting into an open end of said drum means and said drum means being rotatable about said stationary support and said drum means including a side wall; and,
(e) opening means disposed in said sidewall over a preselected area thereof and substantially the remaining area of said sidewall being solid whereby rotation of said drum means causes corresponding rotation of said opening means and thereby generally radially directs hot air to the position of the food for uniformly heating the food.

2. A device as defined in claim 1, wherein:
(a) said opening means includes a supply opening for directing air towards said food and at least a first return air opening for communicating air from said drum means to said inside.

3. The device as defined in claim 2, wherein:
(a) said supply opening includes a longitudinally extending slot.

4. The device as defined in claim 3, wherein:
(a) said slot is generally rectangular in shape and has substantial length and width.

5. The device as defined in claim 2, wherein:
(a) a plurality of return air openings are disposed about said side wall.

6. The device as defined in claim 5, wherein:
(a) said drum means has a closed end; and,
(b) said return air openings are adjacent said closed end.

7. The device as defined in claim 5, wherein:
(a) said return air openings are generally rectangular in shape.

8. The device as defined in claim 5, wherein:
(a) said supply opening is axially spaced from and angularly disposed between two of said return air openings.

9. The device as defined in claim 2, wherein:
(a) said means for supplying includes heating means for heating air to a preselected temperature;
(b) a supply conduit connects said heating means with said inside; and,
(c) a fan communicates heated air from said heating means to said inside.

10. The device as defined in claim 9, wherein:
(a) said inside includes a pair of annular chambers; and,
(b) a first one of said annular chambers is associated with said supply opening and the other one of said pair of annular chambers is associated with said at least a first return air opening.

11. The device as defined in claim 10, wherein:
(a) said fan has an inlet communicating with the annular chamber associated with said at least a first return air opening for thereby permitting recirculation of air.

12. A device as claimed in claim 1, wherein the drum has an inside, an outside and a cylindrical side wall with a supply opening for permitting the stream of hot air to pass from the outside of the drum to the inside, rotation of the drum causing the supply opening to rotate about the support and the food so the stream of hot air moves about the food.

13. A device as claimed in claim 12, wherein the drum is rotatable about an axis which passes generally through the position for the food on the stationary support.

14. A device as claimed in claim 13, wherein the axis is horizontal, the open end comprising an opening for placing food on the support.

15. A device as claimed in claim 14, wherein the supply opening is located on the side wall of the drum at a position outwards from the position for the food on the stationary support.

16. A device as claimed in claim 15, wherein the drum has a return air opening for permitting the stream of hot air to return from the inside of the drum to the outside of the drum.

17. A device as claimed in claim 16, wherein the means for supplying the stream of hot air comprises a fan, a supply conduit extending from the fan to the drum near the supply opening thereof and means for heating the stream of air from the fan.

18. A device as claimed in claim 17, wherein the means for heating the stream of air comprises a stationary electric element.

19. A device as claimed in claim 18, further comprising an annular hot air chamber in the housing which extends about the drum to communicate with the supply opening, the electric element being within the hot air chamber and the supply conduit communicating with the hot air chamber.

20. A device as claimed in claim 19, wherein the drum has a closed back end which is opposite the open end, the return air opening being on the side wall of the drum near the back end, the oven further comprising an annular, return air chamber in the housing which extends about the drum to communicate with the return air opening, the fan having an intake communicating with the return chamber so that hot air returning from the inside of the drum is recirculated by the fan through the supply conduit towards the food.

21. A device as claimed in claim 14, further comprising an electric motor operatively connected to the drum for rotating the drum.

22. A device as claimed in claim 16, wherein the drum has a back end and a plurality of said return air openings spaced-apart about the side wall near the back end.

23. A device as claimed in claim 22, further comprising a peripheral seal adjacent the side wall of the drum between the hot air chamber and the return air chamber for sealing said chambers.

24. A device as claimed in claim 17, further comprising a door on the housing adjacent the open end of the drum for access to the support for the food.

25. A device as claimed in claim 24, wherein the support comprises a perforated tray for mounting on the bracket.

26. A device as claimed in claim 17, further comprising a cantilevered bracket for the stationary support, the bracket being connected to the housing near the front end of the drum and extending into the drum through the open end thereof.

27. A device as claimed in claim 18, wherein the electric element is capable of heating the stream of air to a temperature of 450° Farenheit.

28. A device as claimed in claim 1, wherein the drum is rotatable at a speed of generally 7 revolutions per minute.

29. A device for cooking or heating food, comprising:

(a) a housing with an inside;

(b) a stationary support inside said housing having a position for supporting food;

(c) means for supplying a stream of hot air to said inside;

(d) hollow drum means rotatably mounted to said housing and disposed in said inside, said stationary support projects into an open end of said drum means and said drum means is rotatable about said stationary support;

(e) said drum means includes an air impervious side wall;

(f) a plurality of openings are disposed in said side wall; and, (g) a first one of said openings is adapted for communicating heated air from said inside to generally said position and the other ones of said openings are adapted for communicating air from said drum whereby rotation of said drum means causes corresponding rotation of said first one opening for thereby generally radially directing hot air to said position for uniformly heating the food.

30. The device as defined in claim 29, wherein:

(a) a first and second annular chamber are disposed in said inside;

(b) said first annular chamber is associated with said first one opening and said second chamber is associated with the other ones of said openings;

(c) a fan has an inlet communicating with said second annular chamber and an outlet communicating with said first annular chamber for thereby providing recirculation of air; and, (d) electric heating means are associated with said first annular chamber for heating air to a preselected temperature.

* * * * *